US010804682B2

(12) United States Patent
Sekizawa et al.

(10) Patent No.: US 10,804,682 B2
(45) Date of Patent: Oct. 13, 2020

(54) SPARK PLUG

(71) Applicant: NGK SPARK PLUG CO., LTD., Nagoya-shi, Aichi (JP)

(72) Inventors: Takashi Sekizawa, Nagoya (JP); Tomokatsu Kashima, Nagoya (JP); Yasushi Sakakura, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/742,977

(22) Filed: Jan. 15, 2020

(65) Prior Publication Data

US 2020/0244048 A1 Jul. 30, 2020

(30) Foreign Application Priority Data

Jan. 25, 2019 (JP) ..... 2019-011178

(51) Int. Cl.
*H01T 21/02* (2006.01)
*H01T 13/39* (2006.01)
*H01T 21/06* (2006.01)

(52) U.S. Cl.
CPC ..... *H01T 13/39* (2013.01); *H01T 21/02* (2013.01); *H01T 21/06* (2013.01)

(58) Field of Classification Search
CPC ..... H01T 13/39; H01T 21/06; H01T 21/02
USPC ..... 313/141
See application file for complete search history.

(56) References Cited

U.S. PATENT DOCUMENTS

2013/0069516 A1* 3/2013 Sumoyama ..... C22C 5/04 313/141
2013/0214670 A1* 8/2013 Suzuki ..... H01T 21/02 313/141
2017/0033540 A1* 2/2017 Suzuki ..... H01T 13/39
2018/0323584 A1* 11/2018 Igarashi ..... H01T 13/34
2019/0131775 A1* 5/2019 Kawashima ..... H01T 21/02

FOREIGN PATENT DOCUMENTS

JP 2013-41754 A 2/2013

* cited by examiner

*Primary Examiner* — Christopher M Raabe
(74) *Attorney, Agent, or Firm* — Kusner & Jaffe

(57) ABSTRACT

A spark plug including a ground electrode including a base material, a tip having a discharge surface, and a melt portion interposed over an entire area between the tip and the base material and joining the tip to the base material; and a center electrode with a spark gap formed between the center electrode and the discharge surface. The tip has, in an inner area surrounded by an outer peripheral portion of the tip, a thin portion in which a distance between the discharge surface and the melt portion is shorter than a distance between the discharge surface and the melt portion in the outer peripheral portion. The thin portion extends from a part of the outer peripheral portion to a part other than the part of the outer peripheral portion.

5 Claims, 4 Drawing Sheets

SPARK PLUG

FIELD OF THE INVENTION

The present invention relates to a spark plug, and in particular, relates to a spark plug in which a tip is joined to a base material of a ground electrode.

BACKGROUND OF THE INVENTION

Regarding a spark plug having a spark gap formed between a tip of a ground electrode and a center electrode, in technology disclosed in Japanese Laid-Open Patent Publication No. 2013-41754, a melt portion joining a base material of the ground electrode and the tip is interposed over the entire area between the base material and the tip.

However, in the above conventional technology, depending on the size of the tip, stress repeatedly occurring in the tip and the melt portion through thermal expansion/contraction becomes great due to the difference between the linear expansion coefficient of the base material and the linear expansion coefficient of the tip, whereby the tip or the melt portion might be broken. If the tip or the melt portion is broken, the tip might come off from the base material.

SUMMARY OF THE INVENTION

The present invention has been made to solve the above problem, and an object of the present invention is to provide a spark plug that can inhibit the tip from coming off.

Means for Solving the Problems

To achieve the above object, a spark plug according to the present invention includes: a ground electrode including a base material, a tip having a discharge surface, and a melt portion interposed over an entire area between the tip and the base material and joining the tip to the base material; and a center electrode with a spark gap formed between the center electrode and the discharge surface. The tip has, in an inner area surrounded by an outer peripheral portion of the tip, a thin portion in which a distance between the discharge surface and the melt portion is shorter than a distance between the discharge surface and the melt portion in the outer peripheral portion. The thin portion extends from a part of the outer peripheral portion to a part other than the part of the outer peripheral portion.

Effects of the Invention

In the spark plug according to the first aspect, the tip joined to the base material via the melt portion has, in the inner area surrounded by the outer peripheral portion of the tip, the thin portion in which the distance between the discharge surface of the tip and the melt portion is shorter than the distance between the discharge surface and the melt portion in the outer peripheral portion of the tip. Therefore, when the tip is consumed through discharge, the melt portion is more likely to be exposed from the thin portion than from the outer peripheral portion of the tip. Since the thin portion extends from a part of the outer peripheral portion of the tip to a part other than that part, the tip can be subdivided when the thin portion disappears and the melt portion is exposed. Therefore, stress occurring in the tip and the melt portion due to the difference between the linear expansion coefficient of the base material and the linear expansion coefficient of the tip can be reduced. Thus, breakage of the tip and the melt portion can be inhibited, whereby the tip can be inhibited from coming off.

In the spark plug according to the second aspect, the thin portion passes through the center of the discharge surface. Therefore, when the thin portion disappears and the melt portion is exposed, the tip can be subdivided so as to sandwich the center of the discharge surface. As a result, size variations of the subdivided tips can be reduced as compared to the case where the thin portion does not pass through the center of the discharge surface. Variations of stress occurring in the tip and the melt portion can be reduced, and therefore, in addition to the effects according to the first aspect, the tip can be further inhibited from coming off.

In the spark plug according to the third aspect, the melt portion is formed at the first end of the base material, and the second end located at the side opposite to the first end is joined to the metal shell. The thin portion extends in the direction from the first end toward the second end. Therefore, in addition to the effects according to the first or second aspect, an effect is obtained against thermal expansion/contraction that occurs in a direction crossing the direction from the first end toward the second end of the base material.

In the spark plug according to the fourth aspect, the melt portion is formed at the first end of the base material, and the second end located at the side opposite to the first end is joined to the metal shell. The thin portion extends in a direction crossing the direction from the first end toward the second end. Therefore, in addition to the effects according to the first or second aspect, an effect is obtained against thermal expansion/contraction that occurs in the direction from the first end toward the second end of the base material.

DETAILED DESCRIPTION OF THE INVENTION

Figure 1:
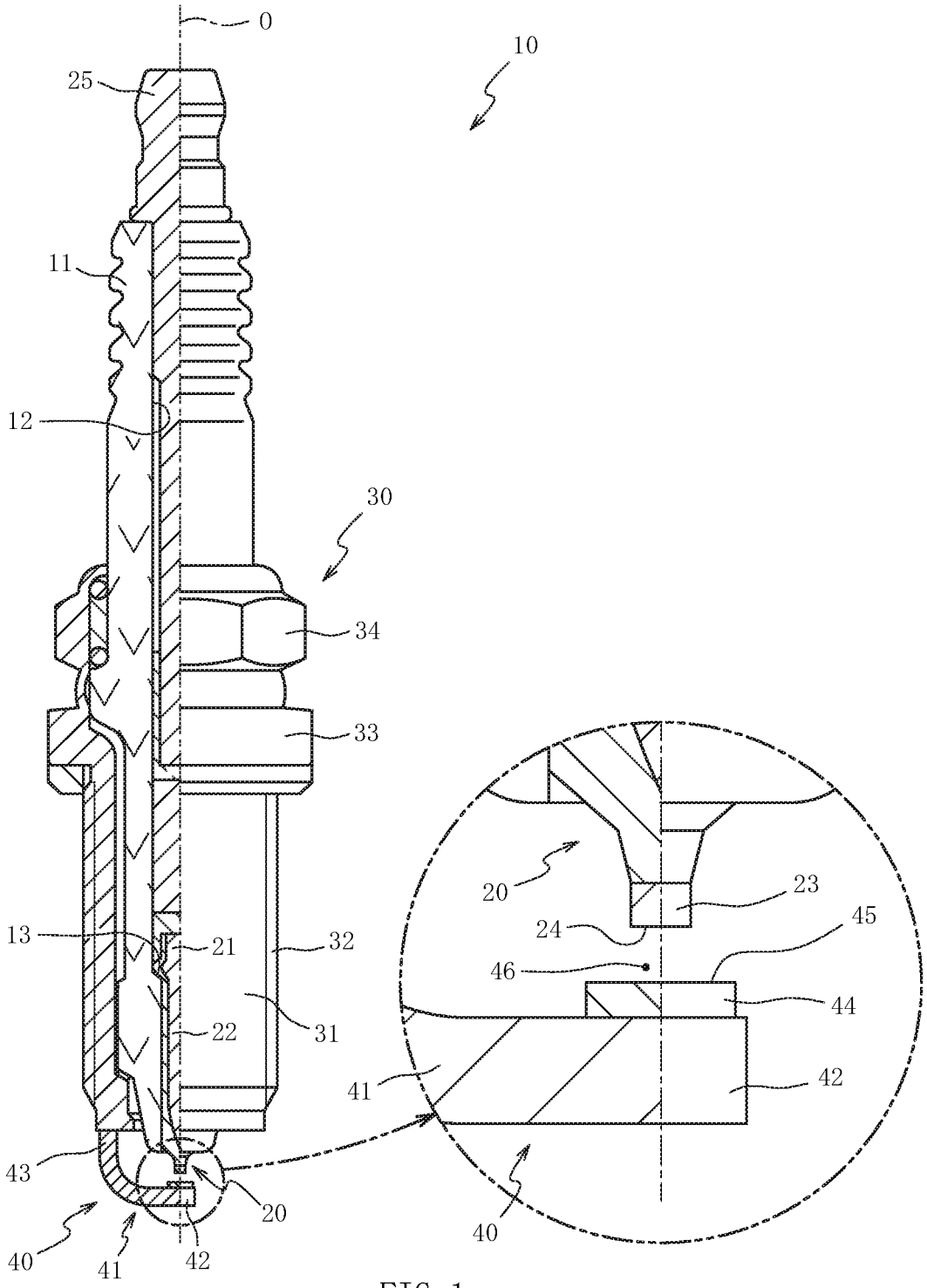
FIG. 1 is a half-sectional view of a spark plug according to the first embodiment.

Hereinafter, preferred embodiments of the present invention will be described with reference to the accompanying drawings. FIG. 1 is a half-sectional view of a spark plug 10 according to the first embodiment, with an axial line O as a boundary. In FIG. 1, the lower side on the drawing sheet is referred to as a front side of the spark plug 10, and the upper side on the drawing sheet is referred to as a rear side of the spark plug 10. As shown in FIG. 1, the spark plug 10 includes an insulator 11, a center electrode 20, a metal shell 30, and a ground electrode 40.

The insulator 11 is a substantially cylindrical member having an axial hole 12 formed along the axial line O, and is made from ceramic such as aluminum which is excellent in mechanical property and in insulation property under high temperature. In the insulator 11, a rearward facing surface 13 facing the rear side and having an annular shape is formed at the front side on an inner circumferential surface formed by the axial hole 12. The diameter of the rearward facing surface 13 decreases toward the front side.

The center electrode 20 is a bar-shaped member having a head portion 21 engaged with the rearward facing surface 13, and has an axial portion 22 located in the axial hole 12 at the front side with respect to the rearward facing surface 13. The center electrode 20 is formed by coating a core material containing copper as a main component with a bottomed cylindrical base material containing Ni as a main component. The core material may not be provided. A tip 23 is joined to the front end of the base material of the center electrode 20. The tip 23 has a chemical composition containing one kind or two or more kinds of noble metals such as Pt, Rh, Ir, and Ru, and containing one kind of these noble metals in an amount of not less than 50 wt %. The center electrode 20 is electrically connected to a metal terminal 25 in the axial hole 12.

The metal terminal 25 is a bar-shaped member to which a high-voltage cable (not shown) is connected, and is made from a conductive metal material (e.g., low-carbon steel). The metal terminal 25 is fixed to the rear end of the insulator 11 in a state in which the front side of the metal terminal 25 is inserted into the axial hole 12.

The metal shell 30 is a substantially cylindrical member made from a conductive metal material (e.g., low-carbon steel). The metal shell 30 surrounds the front side of the insulator 11 and retains the insulator 11 on the inner side. The metal shell 30 has an external thread 32 formed on the outer circumferential surface of a trunk portion 31 at the front side of the metal shell 30. The external thread 32 is a part to be screwed to a screw hole of an engine (not shown). The metal shell 30 has a seat portion 33 contiguous to the rear side of the trunk portion 31, and a rear end portion 34 contiguous to the rear side of the seat portion 33.

The seat portion 33 is a part for closing the gap between the screw hole of the engine (not shown) and the external thread 32, and has an outer diameter larger than the outer diameter of the trunk portion 31. The rear end portion 34 has a tool engagement portion with which a tool such as a wrench is to be engaged when the external thread 32 is tightened to the screw hole of the engine. The ground electrode 40 is connected to the trunk portion 31 of the metal shell 30.

The ground electrode 40 has a base material 41 made from a conductive metal material (e.g., Ni-based alloy), and a tip 44 joined to the base material 41. The base material 41 is a bar-shaped member having a first end 42 to which the tip 44 is joined, and a second end 43 joined to the metal shell 30. The material of the tip 44 is different from the material of the base material 41, and the linear expansion coefficient of the tip 44 is different from the linear expansion coefficient of the base material 41.

The tip 44 has a chemical composition containing one kind or two or more kinds of noble metals such as Pt, Rh, Ir, and Ru, and containing one kind of these noble metals in an amount of not less than 50 wt %. Among these, in particular, a chemical composition containing Ir in an amount of not less than 50 wt %, or a chemical composition containing Pt in an amount of not less than 50 wt % and further containing Ir, is preferable. Such a chemical composition facilitates formation of a thin portion 61 described later.

A spark gap 46 is formed between the discharge surface 45 of the tip 44 that faces the rear side, and the center electrode 20 (the front end surface 24 of the tip 23). Preferably, the discharge surface 45 has a rectangular shape in which the length of each side is not less than 2.5 mm, or a round shape having a size equivalent thereto. Such a shape facilitates formation of the thin portion 61 described later.

Figure 2A:
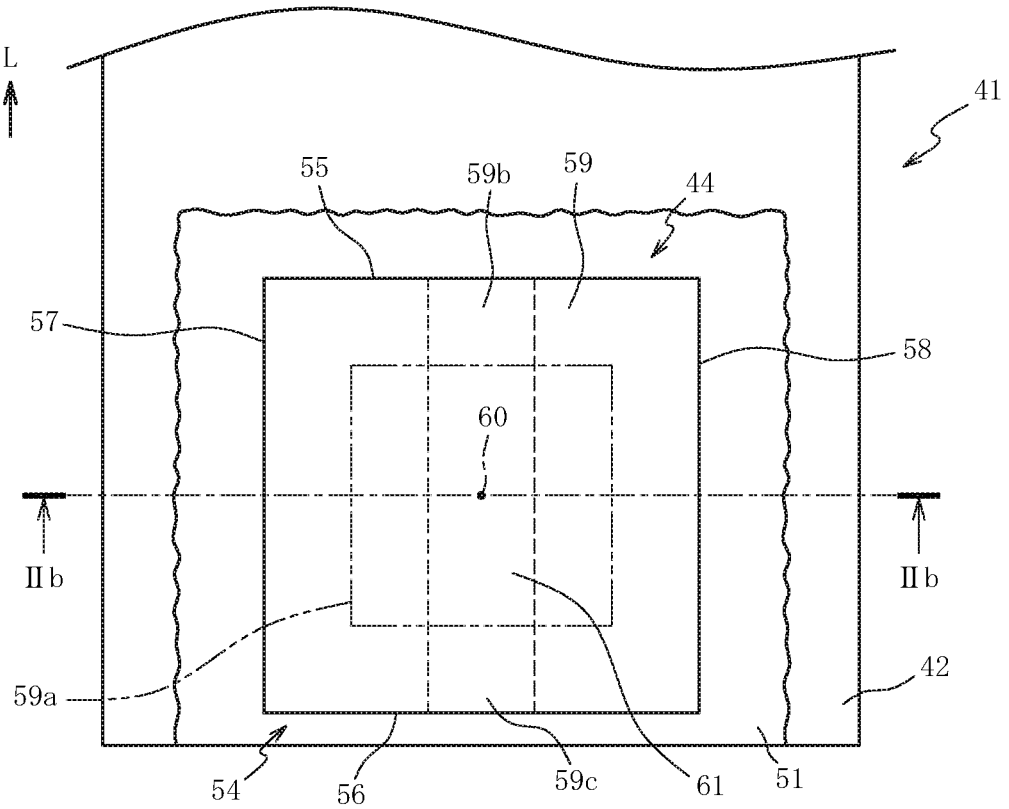
FIG. 2A is a back view of a ground electrode.
Figure 2B:
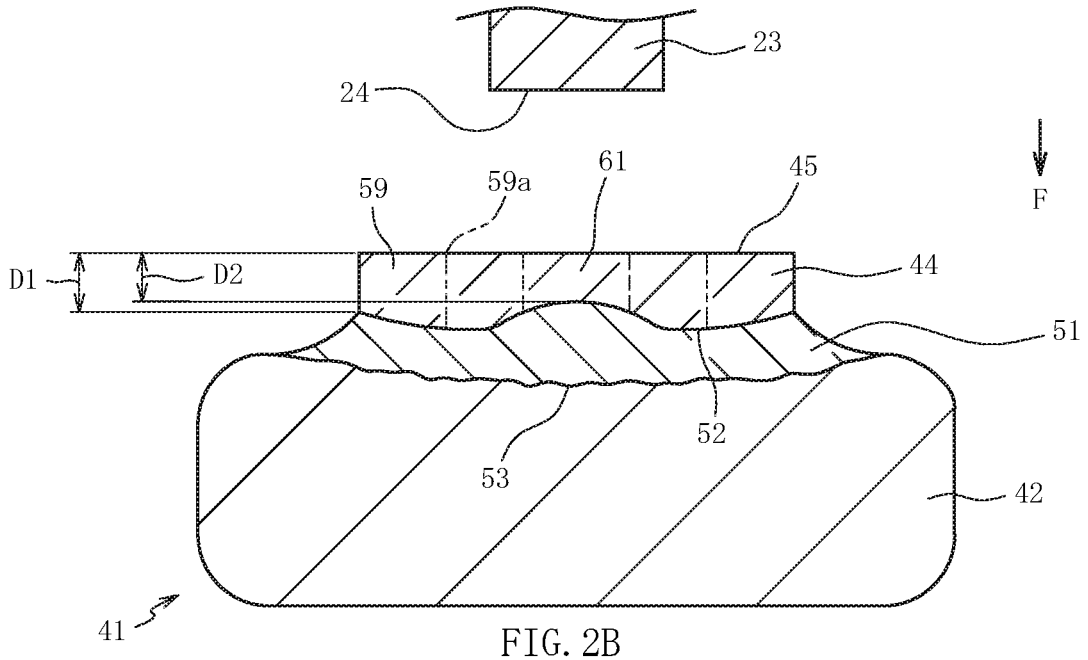
FIG. 2B is a sectional view of the ground electrode along line IIb-IIb in FIG. 2A.

FIG. 2A is a back view of the ground electrode 40 when the tip 44 is viewed from the rear side, and FIG. 2B is a sectional view of the ground electrode 40 and the center electrode 20 along line IIb-IIb in FIG. 2A. In FIG. 2A, the first end 42 of the base material 41 is shown and the second end 43 (see FIG. 1) is not shown (the same applies in FIG. 3A and FIG. 4A). In FIG. 2B, the rear side of the tip 23 of the center electrode 20 is not shown (the same applies in FIG. 3B and FIG. 4B).

Figure 3A:
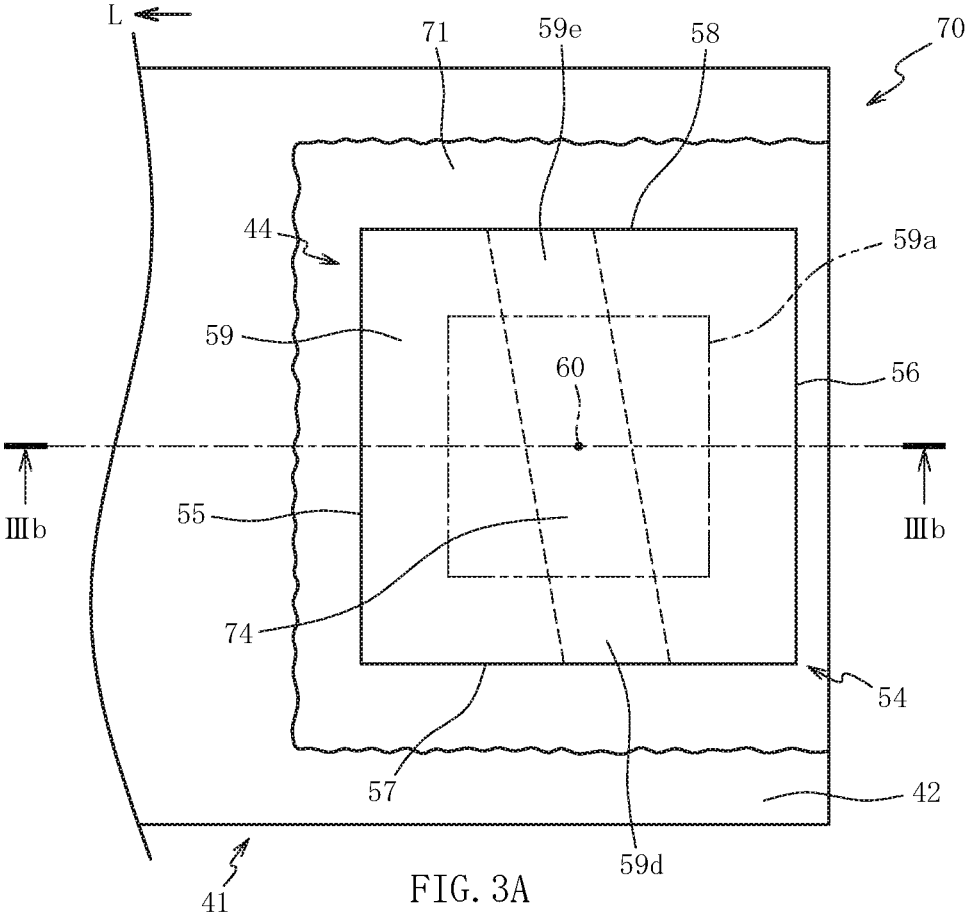
FIG. 3A is a back view of a ground electrode of a spark plug according to the second embodiment.
Figure 3B:
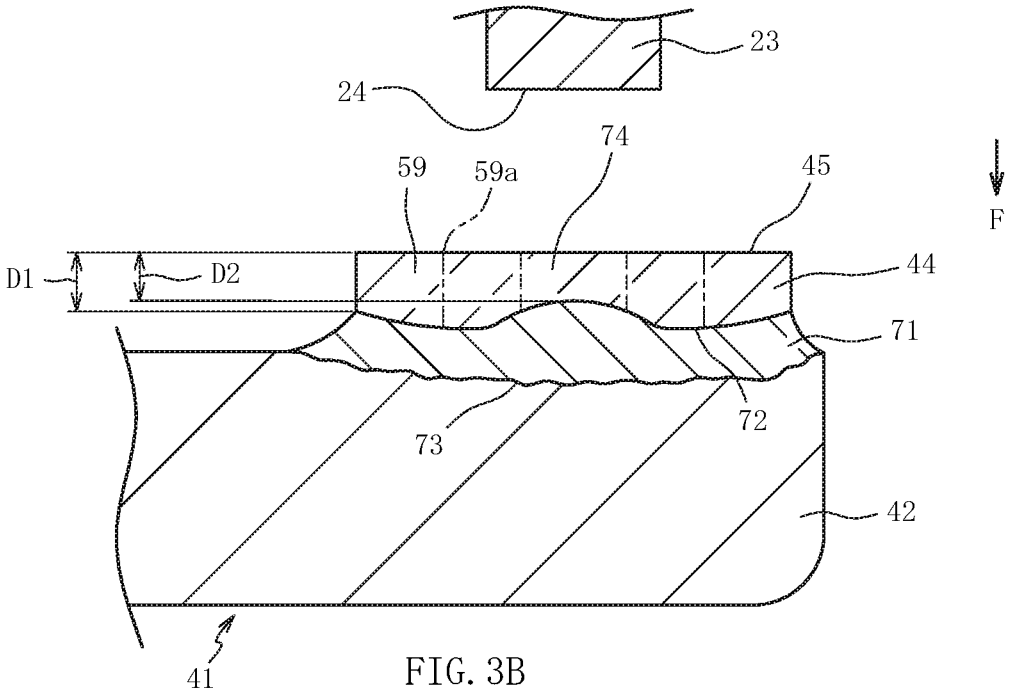
FIG. 3B is a sectional view of the ground electrode along line IIIb-IIIb in FIG. 3A.
Figure 4A:
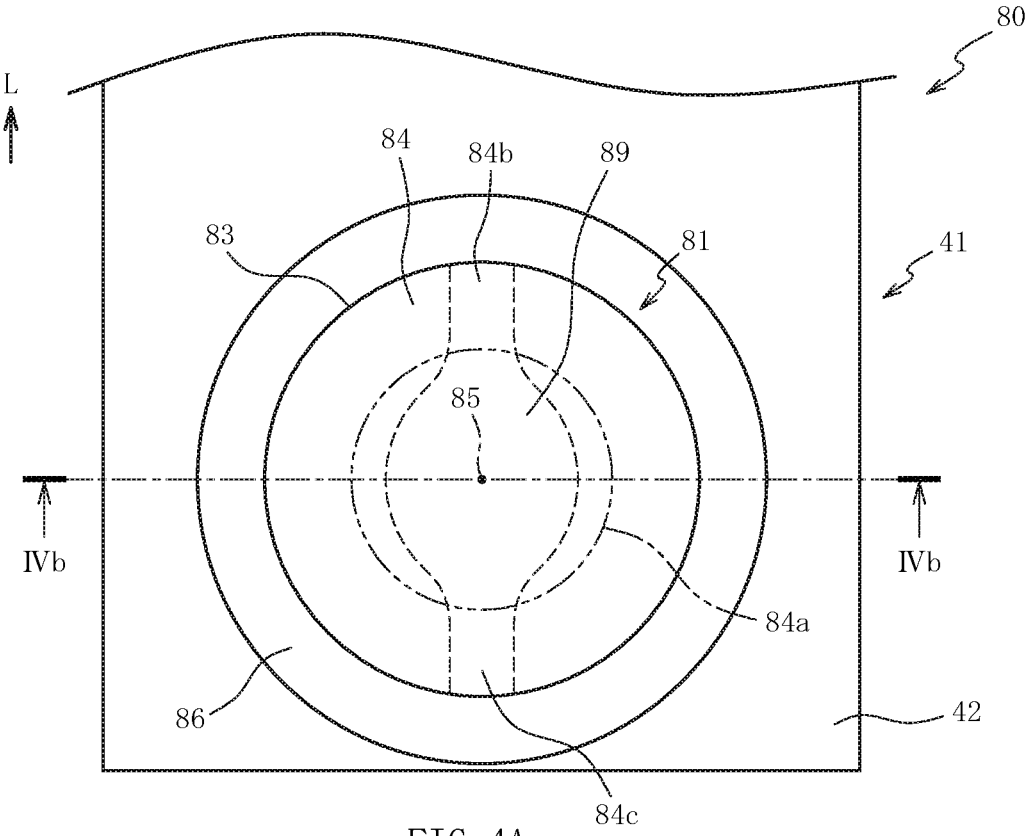
FIG. 4A is a back view of a ground electrode of a spark plug according to the third embodiment.

An arrow L in FIG. 2A indicates the longitudinal direction of the base material 41 extending from the first end 42 to the second end 43 of the base material 41 (the same applies in FIG. 3A and FIG. 4A). An arrow F in FIG. 2B indicates a frontward direction in the axial-line direction of the spark plug 10 (see FIG. 1) (the same applies in FIG. 3B and FIG. 4B). In the present embodiment, the discharge surface 45 of the tip 44 is formed in a rectangular plate shape. The area of the discharge surface 45 of the tip 44 is larger than the area of the front end surface 24 of the tip 23 of the center electrode 20.

As shown in FIG. 2A and FIG. 2B, the tip 44 is joined to the base material 41 such that a melt portion 51 in which the base material 41 and the tip 44 are melted together is formed at the first end 42 of the base material 41. As a result of formation of the melt portion 51, a surface of the tip 44 that is opposite to the discharge surface 45 is melted over the entire area so as to disappear. An interface 52 between the tip 44 and the melt portion 51 bulges in the vicinity of the center toward the rear side (in the direction opposite to the arrow F direction). The distance in the axial-line direction between the interface 52 and an interface 53 between the base material 41 and the melt portion 51 is the longest in the vicinity of the center.

An outer peripheral edge 54 of the discharge surface 45 of the tip 44 is formed from a first side 55 and a second side 56 opposite to each other and a third side 57 and a fourth side 58 that are connected to the first side 55 and the second side 56. The third side 57 and the fourth side 58 are opposite to each other. The first side 55 is located at the second end 43 (see FIG. 1) side in the longitudinal direction (arrow L direction) of the base material 41 with respect to the second side 56.

In a back view of the first end 42 as seen in the direction perpendicular to the discharge surface 45 of the tip 44 (see FIG. 2A), the melt portion 51 spreads to the surrounding area of the outer peripheral edge 54 of the tip 44. In the present embodiment, since the discharge surface 45 of the tip 44 has a rectangular plate shape, the outline of the tip 44 expressing the shape of its part that can be seen in the direction perpendicular to the discharge surface 45 of the tip 44 is equal to the outer peripheral edge 54 of the discharge surface 45 of the tip 44.

An outer peripheral portion 59 of the tip 44 is an area between the outline (in the present embodiment, the outer peripheral edge 54) of the tip 44 and a reduced-scale line 59*a* obtained by reducing the outline to 60%. The outline of the tip 44 is similar to the reduced-scale line 59*a*. The center of the outline of the tip 44 and the center of the reduced-scale line 59*a* coincide with a center 60 of the discharge surface 45. The width of the outer peripheral portion 59 is the distance between the outline of the tip 44 and the reduced-scale line 59*a* located at the inner side of the outline. Of the outer peripheral portion 59, parts that are respectively in contact with the first side 55 and the second side 56 have widths that are 20% of the distance between the first side 55 and the second side 56. Of the outer peripheral portion 59, parts that are respectively in contact with the third side 57 and the fourth side 58 have widths that are 20% of the distance between the third side 57 and the fourth side 58.

Since the interface 52 of the melt portion 51 bulges in the vicinity of the center, the tip 44 has, in the inner area surrounded by the outer peripheral portion 59, a thin portion 61 in which a distance D2 between the discharge surface 45 and the melt portion 51 (interface 52) is shorter than a distance D1 between the discharge surface 45 and the melt portion 51 in the outer peripheral portion 59 (see FIG. 2B). The thin portion 61 extends from a part (part 59*b*) of the outer peripheral portion 59 to a part 59*c* (excluding the part 59*b*) of the outer peripheral portion 59.

In the present embodiment, the part 59*b* of the outer peripheral portion 59 is in contact with the first side 55, and the part 59*c* is in contact with the second side 56. The thin portion 61 passes through the center 60 of the discharge surface 45 of the tip 44. The thin portion 61 extends in a direction from the first end 42 toward the second end 43. A part of the thin portion 61 is present within a range where the front end surface 24 of the tip 23 (see FIG. 2B) of the center electrode 20 is projected toward the front side along the axial line O.

The thin portion 61 is specified on the basis of a result obtained by cutting the ground electrode 40 along the direction perpendicular to the discharge surface 45 of the tip 44 and observing the cross-section thereof by a microscope or the like. For example, cross-sections are sequentially made, from the second side 56 toward the first side 55 of the tip 44, at intervals of 20% of the distance between the first side 55 and the second side 56 of the tip 44 (i.e., the tip 44 is equally divided into five), and the shape of the thin portion 61 in each cross-section is observed. From a plurality of results of cross-section observations, the entire shape of the thin portion 61 can be estimated.

The distance D1 is the shortest distance between the discharge surface 45 and the melt portion 51 in the outer peripheral portion 59 (excluding parts 59*b*, 59*c*), in the observed cross-section of the ground electrode 40. A part where the distance between the discharge surface 45 and the melt portion 51 is shorter than the distance D1 corresponds to the thin portion 61. The thin portion 61 is specified by comparing the distance D2 with the distance D1.

Here, a distance D3 (not shown) between the discharge surface 45 and the melt portion 51 in the parts 59*b*, 59*c* of the outer peripheral portion 59 is shorter than the distance D1 in the outer peripheral portion 59 excluding the parts 59*b*, 59*c*. Therefore, if the thin portion 61 is specified by comparison with the distance D3, the range of the thin portion 61 becomes extremely small. Accordingly, in estimation for the entire shape of the thin portion 61 from a plurality of results of cross-section observations, the positions of the parts 59*b*, 59*c* are also specified and then the distance D1 between the discharge surface 45 and the melt portion 51 in the outer peripheral portion 59 (excluding parts 59*b*, 59*c*) is determined, thereby evaluating the distance D2 and specifying the thin portion 61. In the case where the tip 44 has such a chemical composition that allows X-rays to transmit therethrough, it is possible to specify the shape of the thin portion 61 by nondestructive inspection using an X-ray fluoroscope.

The thin portion 61 of the tip 44 can be formed by applying a high-energy beam such as a laser beam to the boundary between the tip 44 and the base material 41, from a direction substantially parallel to the discharge surface 45 of the tip 44. For example, first, the beam is moved in the arrow L direction along the third side 57 of the tip 44, to apply the beam to the boundary between the tip 44 and the base material 41. The energy of the beam and the like are adjusted so that the melt portion 51 is formed beyond the center 60 of the discharge surface 45. Next, the beam is moved in the direction opposite to the arrow L direction along the fourth side 58 of the tip 44, to apply the beam to the boundary between the tip 44 and the base material 41. The energy of the beam and the like are adjusted so that a melt portion overlaps the melt portion 51 formed first. Thus, the interface 52 of the melt portion 51 formed from the two directions can be bulged in the vicinity of the center, whereby the thin portion 61 is formed in the tip 44.

In the spark plug 10, the thin portion 61 is present at the inner area surrounded by the outer peripheral portion 59 of the tip 44. Therefore, when the tip 44 is consumed through discharge, the melt portion 51 is more likely to be exposed from the thin portion 61 than from the outer peripheral portion 59 of the tip 44. The thin portion 61 extends from a part of the outer peripheral portion 59 to a part other than that part. Therefore, when the thin portion 61 disappears and the melt portion 51 is exposed, the tip 44 can be subdivided. Thus, stress that occurs in the tip 44 and the melt portion 51 due to the difference between the linear expansion coefficient of the base material 41 and the linear expansion coefficient of the tip 44 can be reduced. Therefore, breakage of the tip 44 and the melt portion 51 due to repetitive occurrences of thermal expansion/contraction can be inhibited. Thus, the tip 44 can be inhibited from coming off.

The thin portion 61 passes through the center 60 of the discharge surface 45 of the tip 44. Therefore, when the thin portion 61 disappears and the melt portion 51 is exposed, the tip 44 can be subdivided so as to sandwich the center 60 of the discharge surface 45. As a result, size variations of the subdivided tips 44 can be reduced as compared to the case where the thin portion 61 does not pass through the center 60 of the discharge surface 45. Variations of stress occurring in the tip 44 and the melt portion 51 can be reduced, and therefore the tip 44 can be further inhibited from coming off.

A part of the thin portion 61 is present within a range where the front end surface 24 of the tip 23 of the center electrode 20 is projected toward the front side. Therefore, the thin portion 61 can be readily consumed by discharge between the tips 23 and 44. Subdivision of the tip 44 by the disappearance of the thin portion 61 can be facilitated, and therefore breakage of the tip 44 and the melt portion 51 due to thermal expansion/contraction can be further inhibited.

The thin portion 61 extends in the direction (arrow L direction) from the first end 42 toward the second end 43 of the base material 41. This can facilitate inhibition of breakage of the tip 44 and the melt portion 51 due to thermal expansion/contraction that occurs in a direction crossing the direction from the first end 42 toward the second end 43 of the base material 41.

With reference to FIG. 3, the second embodiment will be described. In the second embodiment, the case where a thin portion 74 of the tip 44 extends in a direction crossing the direction from the first end 42 toward the second end 43 of the base material 41 will be described. The same parts as those described in the first embodiment are denoted by the same reference characters, and the description thereof is omitted.

FIG. 3A is a back view of a ground electrode 70 when the tip 44 of the spark plug according to the second embodiment is viewed from the back side, and FIG. 3B is a sectional view of the ground electrode 70 and the center electrode 20 along line in FIG. 3A. The ground electrode 70 is provided in place of the ground electrode 40 of the spark plug 10 according to the first embodiment.

The tip 44 of the ground electrode 70 is joined to the base material 41 such that a melt portion 71 in which the base material 41 and the tip 44 are melted together is formed at the first end 42 of the base material 41. An interface 72 between the tip 44 and the melt portion 71 bulges in the vicinity of the center toward the rear side (in the direction opposite to the arrow F direction). The distance in the axial-line direction between the interface 72 and an interface 73 between the base material 41 and the melt portion 71 is the longest in the vicinity of the center.

Since the interface 72 of the melt portion 71 bulges in the vicinity of the center, the tip 44 has, in the inner area surrounded by the outer peripheral portion 59, a thin portion 74 in which a distance D2 between the discharge surface 45 and the melt portion 71 (interface 72) is shorter than a distance D1 between the discharge surface 45 and the melt portion 71 in the outer peripheral portion 59 (see FIG. 3B). The thin portion 74 extends from a part (part 59*d*) of the outer peripheral portion 59 to a part 59*e* (excluding the part 59*d*) of the outer peripheral portion 59. The part 59*d* of the outer peripheral portion 59 is in contact with the third side 57, and the part 59*e* is in contact with the fourth side 58. The thin portion 74 passes through the center 60 of the discharge surface 45 of the tip 44. The thin portion 74 extends in a direction crossing a direction from the first end 42 toward the second end 43.

The thin portion 74 can be formed as follows. For example, first, a high-energy beam is moved along the first side 55 of the tip 44, to apply the beam to the boundary between the tip 44 and the base material 41. Next, the beam is moved along the second side 56 of the tip 44, to apply the beam to the boundary between the tip 44 and the base material 41.

The thin portion 61 extends in the direction crossing the direction (arrow L direction) from the first end 42 toward the second end 43 of the base material 41. This can facilitate inhibition of breakage of the tip 44 and the melt portion 71 due to thermal expansion/contraction that occurs in the direction from the first end 42 toward the second end 43 of the base material 41. Besides, the spark plug according to the second embodiment can provide the same effects as in the spark plug 10 according to the first embodiment.

With reference to FIG. 4, the third embodiment will be described. In the first embodiment and the second embodiment, the case where the tip 44 having the rectangular discharge surface 45 is joined to the base material 41 has been described. On the other hand, in the third embodiment, the case where a tip 81 having a round discharge surface 82 is joined to the base material 41 will be described. The same parts as those described in the first embodiment are denoted by the same reference characters, and the description thereof is omitted.

Figure 4B:
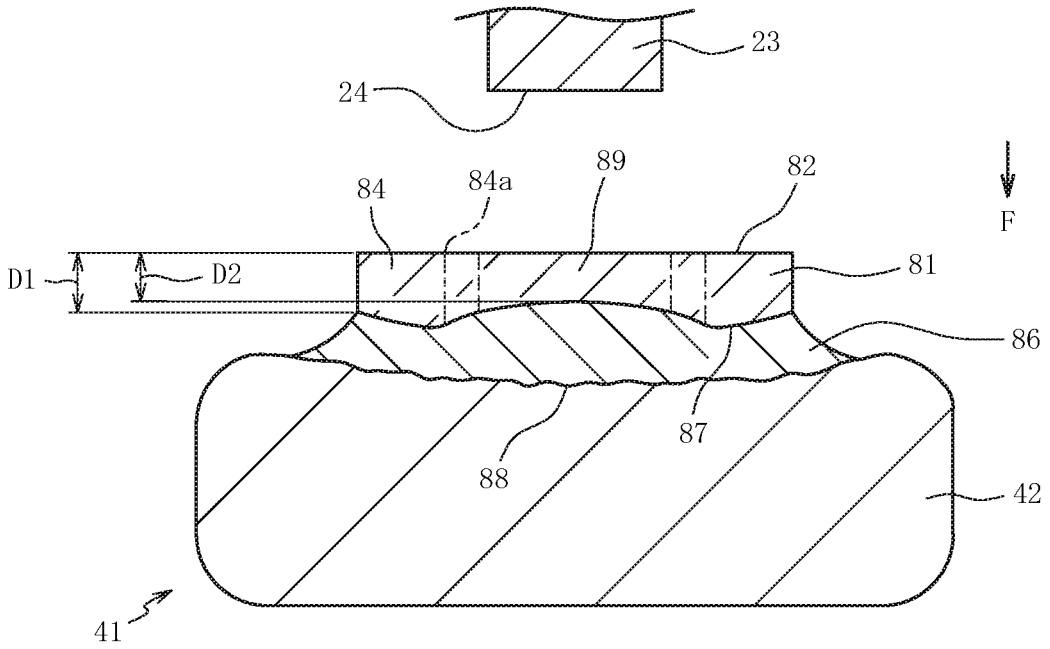
FIG. 4B is a sectional view of the ground electrode along line IVb-IVb in FIG. 4A.

FIG. 4A is a back view of a ground electrode 80 when the tip 81 of the spark plug according to the third embodiment is viewed from the rear side, and FIG. 4B is a sectional view of the ground electrode 80 and the center electrode 20 along line IVb-IVb in FIG. 4A. In FIG. 4A, the first end 42 of the base material 41 is shown and the second end 43 (see FIG. 1) is not shown. The ground electrode 80 is provided in place of the ground electrode 40 of the spark plug 10 according to the first embodiment.

The tip 81 of the ground electrode 80 has a columnar shape, and an outer peripheral edge 83 of the discharge surface 82 has a round shape. In a back view of the first end 42 as seen in the direction perpendicular to the discharge surface 82 of the tip 81 (see FIG. 4A), a melt portion 86 spreads to the surrounding area of the outer peripheral edge 83 of the tip 81. In the present embodiment, since the discharge surface 82 of the tip 81 has a round columnar shape, the outline of the tip 81 expressing the shape of its part that can be seen in the direction perpendicular to the discharge surface 82 of the tip 81 is equal to the outer peripheral edge 83 of the discharge surface 82 of the tip 81.

An outer peripheral portion 84 of the tip 81 is an area between the outline (in the present embodiment, the outer peripheral edge 83) of the tip 81 and a reduced-scale line 84*a* obtained by reducing the outline to 60%. The outline of the tip 81 is similar to the reduced-scale line 84*a*. The center of the outline of the tip 81 and the center of the reduced-scale line 84*a* coincide with a center 85 of the discharge surface 82. The width of the outer peripheral portion 84 is the distance between the outline of the tip 81 and the reduced-scale line 84*a* located at the inner side of the outline. The width of the outer peripheral portion 84 is 20% of the diameter of the discharge surface 82.

The tip 81 is joined to the base material 41 such that a melt portion 86 in which the base material 41 and the tip 81 are melted together is formed at the first end 42 of the base material 41. An interface 87 between the tip 81 and the melt portion 86 bulges in the vicinity of the center toward the rear side (in the direction opposite to the arrow F direction). The distance in the axial-line direction between the interface 87 and an interface 88 between the base material 41 and the melt portion 86 is the longest in the vicinity of the center.

Since the interface 87 of the melt portion 86 bulges in the vicinity of the center, the tip 81 has, in the inner area surrounded by the outer peripheral portion 84, a thin portion 89 in which a distance D2 between the discharge surface 82 and the melt portion 86 (interface 87) is shorter than a distance D1 between the discharge surface 82 and the melt portion 86 in the outer peripheral portion 84 (see FIG. 4B). The thin portion 89 extends from a part (part 84*b*) of the outer peripheral portion 84 to a part 84*c* (excluding the part 84*b*) of the outer peripheral portion 84. The thin portion 89 passes through the center 85 of the discharge surface 82 of the tip 81. The thin portion 89 extends in a direction from the first end 42 toward the second end 43. A part of the thin portion 89 is present within a range where the front end surface 24 of the tip 23 (see FIG. 4B) of the center electrode 20 is projected toward the front side along the axial line O.

The thin portion 89 can be formed as follows. For example, first, a high-energy beam is moved along the outer peripheral edge 83 of the tip 81 by about a half round of the outer peripheral edge 83, to apply the beam to the boundary between the tip 81 and the base material 41. Next, the beam is moved along the opposite side of the outer peripheral edge 83 of the tip 81 by about a half round of the outer peripheral edge 83, to apply the beam to the boundary between the tip 81 and the base material 41. By adjusting the energy of the beam being moved, the width of the thin portion 89 at the center 85 of the discharge surface 82 can be made greater than the width of the thin portion 89 at the other parts. The spark plug according to the third embodiment can provide the same effects as in the spark plug 10 according to the first embodiment.

Although the present invention has been described with reference to the embodiments, the present invention is not limited to the above embodiments at all. It can be easily understood that various modifications can be devised without departing from the gist of the present invention.

In the above embodiments, the case where the discharge surface 45, 82 of the tip 44, 81 of the ground electrode 40, 70, 80 has a rectangular shape or a round shape has been described. However, the present invention is not necessarily limited thereto. The rectangular shape may be changed to a shape with a corner rounded or slightly chamfered. The round shape may be changed to an elliptic shape. That is, the shapes of the discharge surfaces 45, 82 may be set optionally.

In the above embodiments, the case where the tip 23 containing a noble metal and the like is provided to the center electrode 20 has been described. However, the present invention is not necessarily limited thereto. As a matter of course, the tip 23 of the center electrode 20 may not be provided. In the case where the tip 23 is not provided, the front end surface of the center electrode 20 refers to the front end surface of the base material.

In the above embodiments, both ends of the thin portion 61, 74, 89 reach the outline of the tip 44, 81 (see FIG. 2A, FIG. 3A, FIG. 4A). However, the present invention is not necessarily limited thereto. As long as the thin portion 61, 74, 89 extends from a part of the outer peripheral portion 59, 84 to a part other than the part of the outer peripheral portion 59, 84, the tip 44, 81 can be expected to be subdivided. Therefore, both ends of the thin portion 61, 74, 89 need not reach the outline of the tip 44, 81. Both ends of the thin portion 61, 74, 89 only need to overlap the outer peripheral portion 59, 84. That is, the thin portion 61, 74, 89 only needs to intersect the reduced-scale line 59*a*, 84*a*.

What is claimed is:

1. A spark plug comprising:

a ground electrode including a base material, a tip having a discharge surface, and a melt portion interposed over an entire area between the tip and the base material and joining the tip to the base material, the base material having a first end and a second end, the melt portion being formed at the first end of the base material, the second end of the base material being located at a side opposite to the first end and joined to a metal shell; and a center electrode with a spark gap formed between the center electrode and the discharge surface, wherein the tip has, in an inner area surrounded by an outer peripheral portion of the tip, a thin portion in which a distance between the discharge surface and the melt portion is shorter than a distance between the discharge surface and the melt portion in the outer peripheral portion, wherein the thin portion extends in a direction from the first end of the base material toward the second end of the base material, and wherein the thin portion extends from a part of the outer peripheral portion of the tip to a part of the outer peripheral portion of the tip other than the part of the outer peripheral portion of the tip.

2. The spark plug according to claim 1, wherein the thin portion passes through a center of the discharge surface.

3. The spark plug according to claim 1, wherein the outer peripheral portion of the tip is an area between an outer peripheral edge of the tip and a reduced-scale outline of the tip, the reduced-scale outline of the tip being 60% of an outline of the tip.

4. The spark plug according to claim 3, wherein, in a back view of the first end of the base material that is seen in a direction that is perpendicular to the discharge surface of the tip, first and second ends of the thin portion are in contact with the outer peripheral edge of the tip.

5. The spark plug according to claim 1, wherein an interface between the melt portion in the thin portion and the tip in the thin portion is curved.

* * * * *